US007554314B2

(12) United States Patent
Sobue et al.

(10) Patent No.: US 7,554,314 B2
(45) Date of Patent: Jun. 30, 2009

(54) CURRENT MIRROR CIRCUIT FOR REDUCING CHIP SIZE

(75) Inventors: Satoshi Sobue, Nukata-gun (JP); Hiroyuki Ban, Hazu-gun (JP); Shigenori Mori, Nukata-gun (JP)

(73) Assignee: DENSO CORPORATION, Kariya (JP)

( * ) Notice: Subject to any disclaimer, the term of this patent is extended or adjusted under 35 U.S.C. 154(b) by 310 days.

(21) Appl. No.: 11/589,878

(22) Filed: Oct. 31, 2006

(65) Prior Publication Data

US 2007/0103139 A1 May 10, 2007

(30) Foreign Application Priority Data

Nov. 4, 2005 (JP) ..... 2005-321001
Jan. 20, 2006 (JP) ..... 2006-011851

(51) Int. Cl.
*G05F 3/16* (2006.01)

(52) U.S. Cl. ..... 323/315

(58) Field of Classification Search ..... 323/315
See application file for complete search history.

(56) References Cited

U.S. PATENT DOCUMENTS 4,158,178 A * 6/1979 Schade, Jr. ..... 330/253
4,567,381 A * 1/1986 Piasecki ..... 327/542
5,304,862 A 4/1994 Memida
5,519,313 A * 5/1996 Wong et al. ..... 323/315
5,990,727 A * 11/1999 Kimura ..... 327/513
6,255,887 B1 * 7/2001 Adams et al. ..... 327/326
2004/0189323 A1 9/2004 Nagase
2007/0103139 A1 * 5/2007 Sobue et al. ..... 323/315

FOREIGN PATENT DOCUMENTS

JP A-2002-149250 5/2002

* cited by examiner

*Primary Examiner*—Jeffrey L Sterrett
(74) *Attorney, Agent, or Firm*—Posz Law Group, PLC

(57) ABSTRACT

A current mirror circuit includes transistors having bases coupled together and emitters connected to a voltage line. The current mirror circuit further includes a zener diode having an anode connected to the bases and a cathode connected to the voltage line. When a base potential of the transistors decreases, a reverse current of the zener diode increases. Therefore, the zener diode has a resistance and acts as a resistor to clamp the base potential of the transistors. A layout area of the zener diode is much smaller than that of the resistor having a resistance equal to that of the zener diode. The current mirror circuit achieves reduced chip size by using the zener diode instead of the resistor.

10 Claims, 10 Drawing Sheets

CURRENT MIRROR CIRCUIT FOR REDUCING CHIP SIZE

CROSS REFERENCE TO RELATED APPLICATION

This application is based on and incorporates herein by reference Japanese Patent Applications No. 2005-321001 filed on Nov. 4, 2005 and No. 2006-11851 filed on Jan. 20, 2006.

FIELD OF THE INVENTION

The present invention relates to a current mirror circuit for achieving reduced chip size and a constant current circuit having the current mirror circuit.

BACKGROUND OF THE INVENTION

A typical current mirror circuit is constructed with transistors having bases coupled together and emitters coupled together. As shown in FIG. 13, a current mirror circuit 1 disclosed in U.S. 2004/0189323A1 corresponding to JP-2004-301670A includes four transistors Q1-Q4. The transistors Q1-Q4 have bases coupled together and emitters connected to a power supply line 2. The current mirror circuit 1 further includes a pullup resistor R1 connected between the bases and the power supply line 2. Each of the transistor Q2-Q4 supplies a collector current Ib to a control circuit 4. The collector current Ib depends on a constant current Ia output from a constant current source 3.

When an integrated circuit (IC) having the current mirror circuit 1 switches to sleep mode, a switch 5 is opened and the supply of the current 1*b* to the control circuit 4 is cut off. The resistor R1 clamps the bases of the transistors Q1-Q4 to a certain voltage potential during periods when the switch 5 is opened. In each of the transistors Q1-Q4, if the base potential is not clamped, a depletion zone expands toward a collector region due to punch-through breakdown. As a result, a leak current flows from the emitter to the collector.

Whereas the resistor R1 prevents the leak current, a current flowing through the resistor R1 introduces error into a mirror gain of the current mirror circuit 1. For example, when the constant current source 3 outputs the constant current Ia of 5 microamperes (μA) and the resistor R1 has a resistance of 500 kilohms (kΩ), the current flowing through the resistor R1 is determined as follows:

$$\frac{VF}{500\ \text{k}\Omega} = \frac{0.7\ \text{V}}{500\ \text{k}\Omega} = 1.4\ \mu\text{A},$$

where VF is a forward bias voltage of the transistors Q1-Q4.

As a result, the collector current Ib decreases to 3.6 μA and the mirror gain decreases to 0.72 even through it is preferable that the mirror gain is 1.

Increasing the resistance of the resistor R1 can reduce the error introduced in the mirror gain. However, the resistor R1 of 500 kΩ has a layout area of about 70 micrometers (μm)×70 μm, which is about half of pad size. The layout area of the resistor R1 increases with the increase in the resistance of the resistor R1. Therefore, increasing the resistance of the resistor R1 increases chip size and manufacturing cost of the IC.

A constant current circuit disclosed in JP-2002-149250A generates a constant current using a current mirror circuit. The current mirror circuit includes a resistor and operates based on a voltage drop across the resistor. It is preferable that the resistor has high resistance for low power consumption. However, as described above, increasing the resistance of the resistor increases the chip size and the manufacturing cost.

SUMMARY OF THE INVENTION

In view of the above-described problem, it is an object of the present invention to provide a current mirror circuit for achieving reduced chip size and a constant current circuit having the current mirror circuit.

A current mirror circuit includes transistors having bases coupled together and emitters connected to a power supply line. The current mirror circuit further includes a zener diode having an anode connected to the bases and a cathode connected to the power supply line. Thus, when a base-emitter junction of the transistors is forward biased, the zener diode is reverse biased.

When a base potential of the transistors varies such that a base-emitter voltage of the transistors increases, a reverse current of the zener diode increases. Therefore, the zener diode has a resistance and acts as a resistor. The variation in the base potential can be prevented by the resistance so that the base potential can be clamped.

The zener diode has a breakdown voltage high than a forward bias voltage of the transistors. Therefore, the zener diode remains off.

A layout area of the zener diode is much smaller than that of the resistor having a resistance equal to the resistance of the zener diode. Therefore, the current mirror circuit can be reduced in size by using the zener diode instead of the resistor. Accordingly, an IC chip having the current mirror circuit can be reduced in size.

In a constant current circuit having the current mirror circuit, the current mirror circuit is driven by the reverse current of the zener diode. In such an approach, the constant current circuit can be reduced in size. Accordingly, an IC chip having the constant current circuit can be reduced in size

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
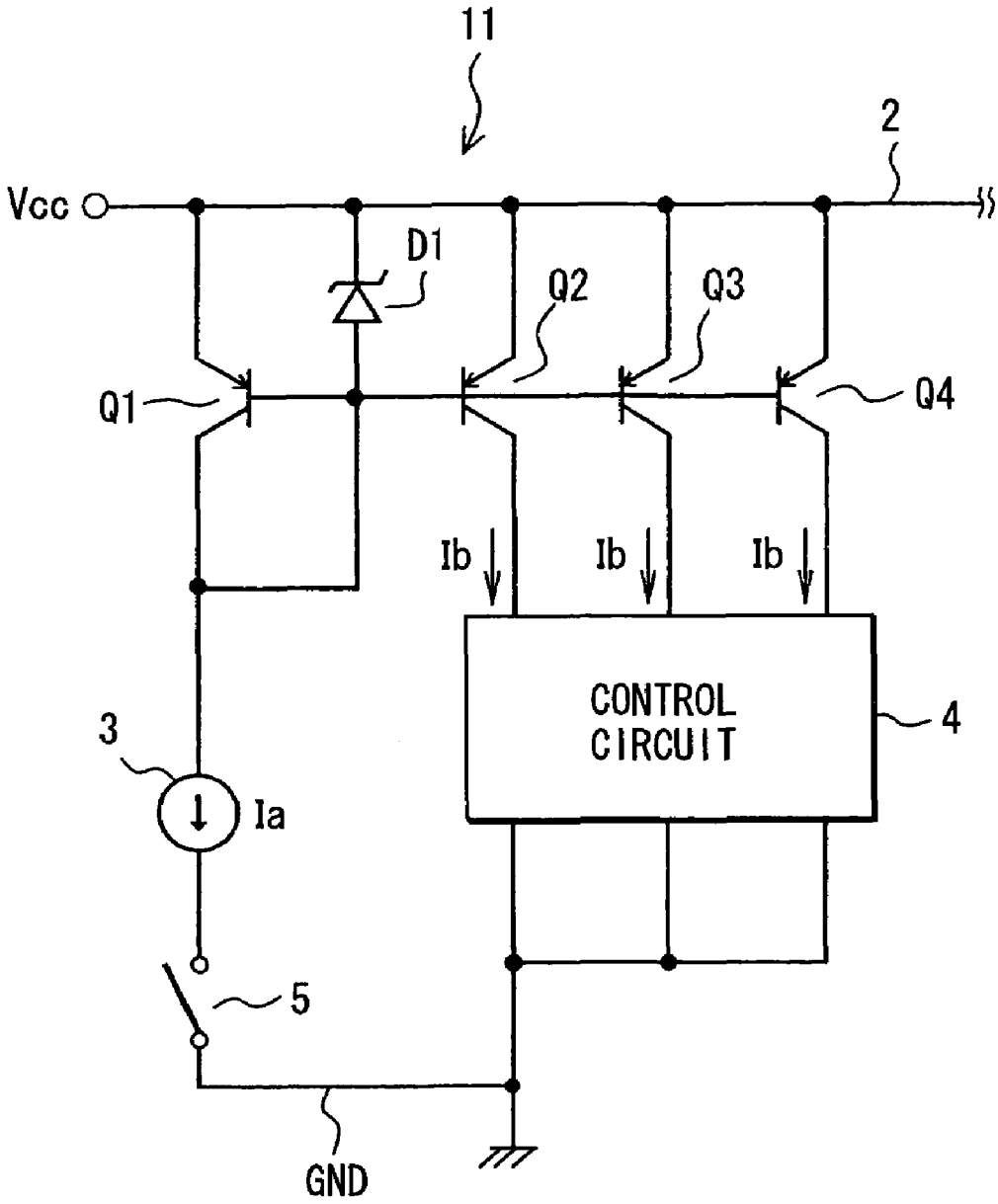
FIG. 1 is a schematic of a current mirror circuit according to a first embodiment of the present invention.
Figure 2A:
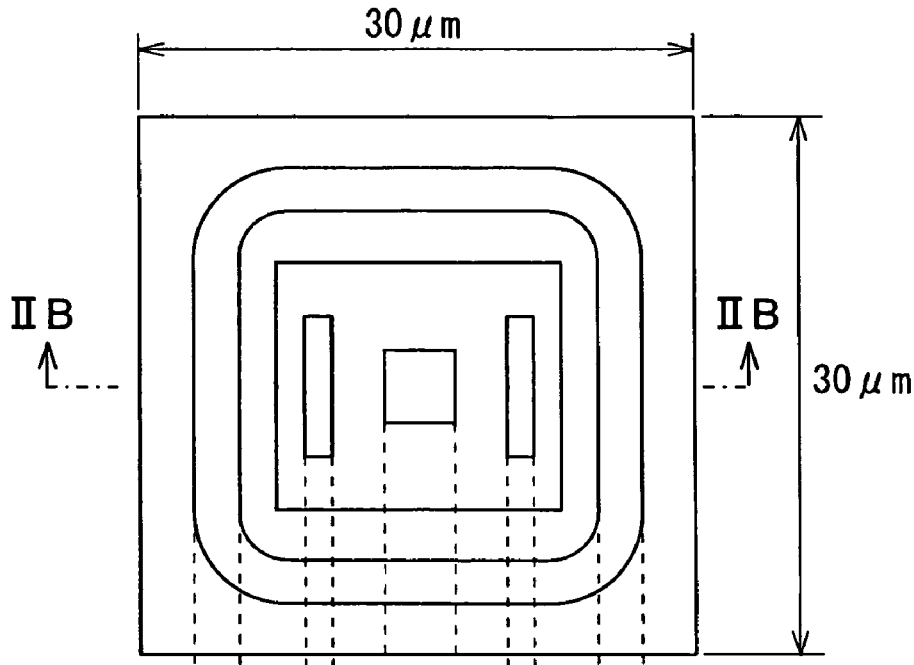
FIG. 2A is a top view of a zener diode used in the current mirror circuit of FIG. 1.
Figure 2B:
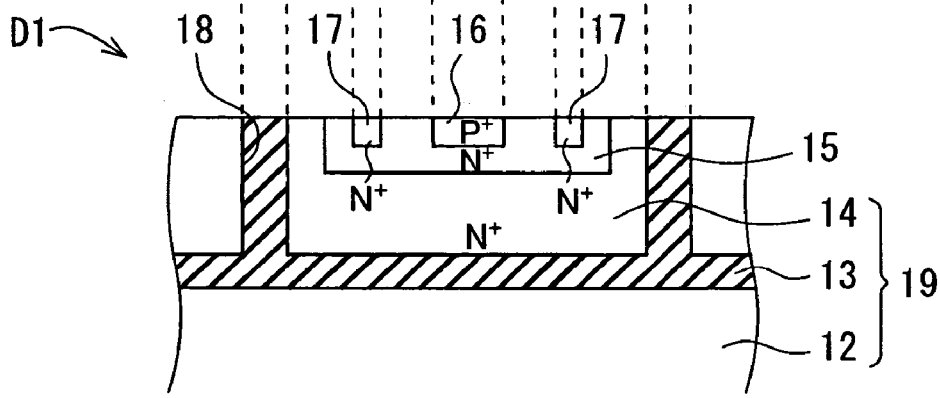
FIG. 2B is a cross sectional view of the zener diode taken along line IIB-IIB in FIG. 2A.
Figure 3:
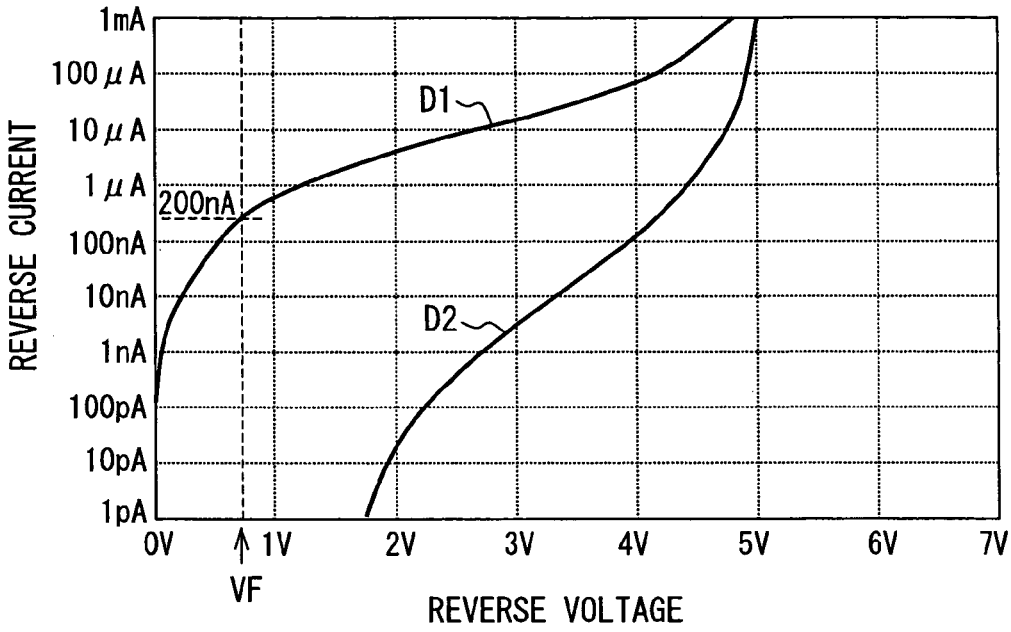
FIG. 3 is a graph showing volt-ampere characteristics of a conventional zener diode and the zener diode used in the current mirror circuit of FIG. 1.

Referring to FIGS. 1-3, a current mirror circuit 11 includes PNP transistors Q1-Q4 having bases coupled together and emitters coupled together and connected to a power supply line 2. Each of the transistors Q1-Q4 has a forward bias voltage VF of about 0.7 volts (V). A power supply voltage Vcc (e.g., 5 V or 14 V) is applied to the power supply line 2.

As shown in FIG. 1, the current mirror circuit 11 further includes a zener diode D1 having a cathode connected to the power supply line 2 and an anode connected to the bases of the transistors Q1-Q4. Thus, when the base-emitter junction of the transistors Q1-Q4 is forward biased, the zener diode D1 is reverse biased. The zener diode D1 has a reverse breakdown voltage (i.e., zener voltage) higher than the forward bias voltage VF.

The base and collector of the transistor Q1 are coupled together. A constant current source 3 for outputting a constant current Ia of 5 μA and a switch 5 are connected in series between the collector of the transistor Q1 and a ground line GND. Each of the transistors Q2-Q4 has a collector connected to a control circuit 4 and supplies a collector current Ib to the control circuit 4. The collector current Ib depends on the constant current Ia. The control circuit 4 may be, for example, an operational amplifier, a comparator, a power supply circuit, or the like and powered by the collector current Ib.

The current mirror circuit 11 is integrated into an integrated circuit (IC). When the IC operates in normal mode, the switch 5 is closed. When the IC switches from the normal mode to sleep mode (i.e., low consumption mode), the switch 5 is opened.

As shown in FIGS. 2A and 2B, the zener diode D1 is fabricated on a silicon-on-insulator (SOI) substrate 19. The SOI substrate 19 includes an N-type silicon substrate 12, a silicon dioxide layer 13 on the N-type silicon substrate 12, and a N+ silicon layer 14 on the silicon dioxide layer 13. The silicon dioxide layer 13 provides electrical isolation.

The N+ silicon layer 14 includes an N+ diffusion layer 15 (i.e., a first conductive diffusion layer) with impurity concentration of more than $1\times10^{20}$ $cm^{-3}$. A P+ diffusion layer 16 (i.e., a second conductive diffusion layer) is fabricated in the center of the surface of the N+ diffusion layer 15. The P+ diffusion layer 16 has the impurity concentration greater than that of the N+ diffusion layer 15. The P+ diffusion layer 16 acts as the anode. A pair of N+ diffusion layers 17 is fabricated in the surface of the N+ diffusion layer 15 to face each other across the P+ diffusion layer 16. The N+ diffusion layers 15, 17 act as the cathode.

The zener diode D1 is electrically isolated from the transistors Q1-Q4 by a trench 18 filled with the silicon dioxide layer 13. The zener diode D1 has a layout area of about 30 μm×30 μm.

FIG. 3 shows volt-ampere characteristics of the zener diode D1 and a standard zener diode D2 having an N+ diffusion layer, which corresponds to the N+ diffusion layer 15, with the impurity concentration of $7\times10^{18}$ $cm^3$. The zener diode D1 has the breakdown voltage of 4.8 V and the standard zener diode D2 has the breakdown voltage of 5.1 V. Since a difference in the impurity concentration between the diffusion layers 15, 16 of the zener diode D1 is larger than that of the zener diode D2, a reverse (leak) current of the zener diode D1 is larger than that of the zener diode D2.

As shown in FIG. 3, when the zener diode D1 is reverse biased at the forward bias voltage VF (i.e., 0.7 V), the reverse current of about 200 nanoamperes (nA) flows through the zener diode D1. Therefore, it is considered that the zener diode D1 has a resistance and acts as a resistor.

In the normal mode where the switch 5 is closed, 200 nA of the constant current Ia of 5 μA flows through the zener diode D1 and 4.8 μA of the constant current Ia of 5 μA flows through the transistor Q1. As long as the transistors Q1-Q4 have the same size, the collector current Ib of each of the transistors Q2-Q4 is 4.8 μA. Therefore, the current mirror circuit 11 has a mirror gain of 0.96. In this case, the zener diode D1 remains off because the breakdown voltage is higher than the forward bias voltage VF.

As described above, whereas the current of 1.4 μA flows through the resistor R1 in the conventional current mirror circuit 1, the current of 200 nA flows through the zener diode D1 in the current mirror circuit 11. In short, the electric current affecting the mirror gain is reduced to one-seventh by replacing the resistor R1 with the zener diode D1. As a result, whereas the conventional current mirror circuit 1 has the mirror gain of 0.72, the current mirror circuit 11 has the mirror gain of 0.96.

Further, whereas the resistor R1 of 500 kΩ has the layout area of 70 μm×70 μm, the zener diode D1 has the layout area of 30 μm×30 μm. The layout area is reduced to one-fifth by replacing the resistor R1 with the zener diode D1.

Therefore, the current mirror circuit 11 has reduced size and the mirror gain with reduced error, as compared to the conventional current mirror circuit 1.

In the sleep mode where the switch 5 is opened, the collector of the transistor Q1 is open circuited. In this case, the reverse current of the zener diode D1 increases with a decrease in the base potential of the transistors Q1-Q4. Thus the decrease in the base potential can be prevented by the resistance of the zener diode D1 so that the base potential is clamped. Therefore, the supply of the collector current Ib to the control circuit 4 can be certainly cut off.

When the constant current source 3 outputs the constant current Ia of 5 μA, the zener diode D1 is fabricated such that the reverse current is 200 nA at the forward bias voltage VF, as shown in FIG. 3. In such an approach, the zener diode D1 can sufficiently reduce the error introduced into the mirror gain and clamp the base potential of the transistors Q1-Q4. When the constant current Ia is smaller than 5 μA, the reverse current of the zener diode D1 is set to a value smaller than 200 nA. In short, the reverse current of the zener diode D1 is set in accordance with the constant current Ia.

As described above, the current mirror circuit 11 includes the zener diode D1 having the cathode connected to the power supply line 2 and the anode connected to the bases of the transistors Q1-Q4. Thus, when the base-emitter junction of the transistors Q1-Q4 is forward biased, the zener diode D1 is reverse biased. In such an approach, the zener diode D1 has the resistance to clamp the base potential of the transistors Q1-Q4.

The layout area of the zener diode D1 is much smaller than that of the resistor having the resistance equal to the resistance of the zener diode D1. Therefore, the current mirror circuit 11 can be reduced in size. Accordingly, the IC having the current mirror circuit 11 can be reduced in size. In particular, since an analog IC uses many current mirror circuits, the analog IC can be much reduced in size by using the current mirror circuit 11 instead of the conventional current mirror circuit 1.

Second Embodiment

Figure 4:
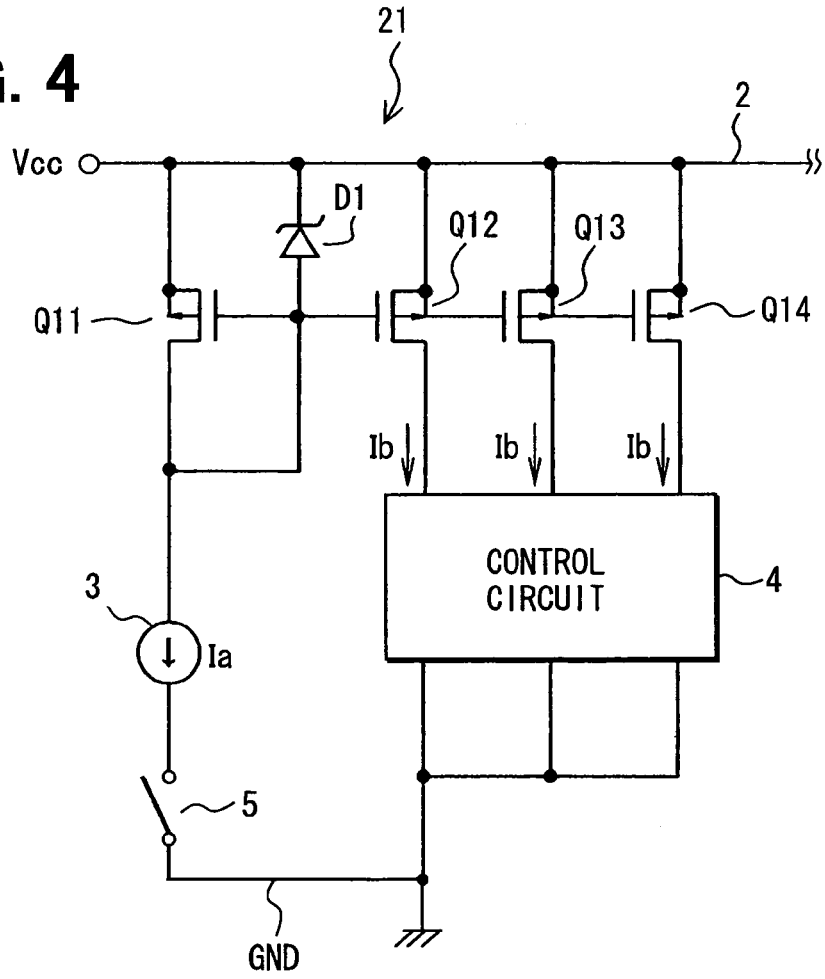
FIG. 4 is a schematic of a current mirror circuit according to a second embodiment of the present invention.

Referring to FIG. 4, a current mirror circuit 21 includes P-channel field-effect transistors (FET) Q11-Q14 having gates coupled together and sources coupled together and connected to the power supply line 2. Each of the FETs Q11-Q14 has a threshold voltage.

The current mirror circuit 21 further includes the zener diode D1 having the cathode connected to the power supply line 2 and the anode connected to the gates of the FETs Q11-Q14. Thus, when a gate-source junction of the FETs Q11-Q14 is forward biased, the zener diode D1 is reverse biased. The zener diode D1 has the breakdown voltage higher than the threshold voltage so that the zener diode D1 remains off.

In such an approach, the zener diode D1 has the resistance to clamp the gate potential of the FETs Q11-Q14. The layout area of the zener diode D1 is much smaller than that of the resistor having the resistance equal to the resistance of the zener diode D1. Therefore, the current mirror circuit 21 can be reduced in size. Accordingly, the IC can be reduced in size by using the current mirror circuit 21 instead of the conventional current mirror circuit 1.

Third Embodiment

Figure 5:
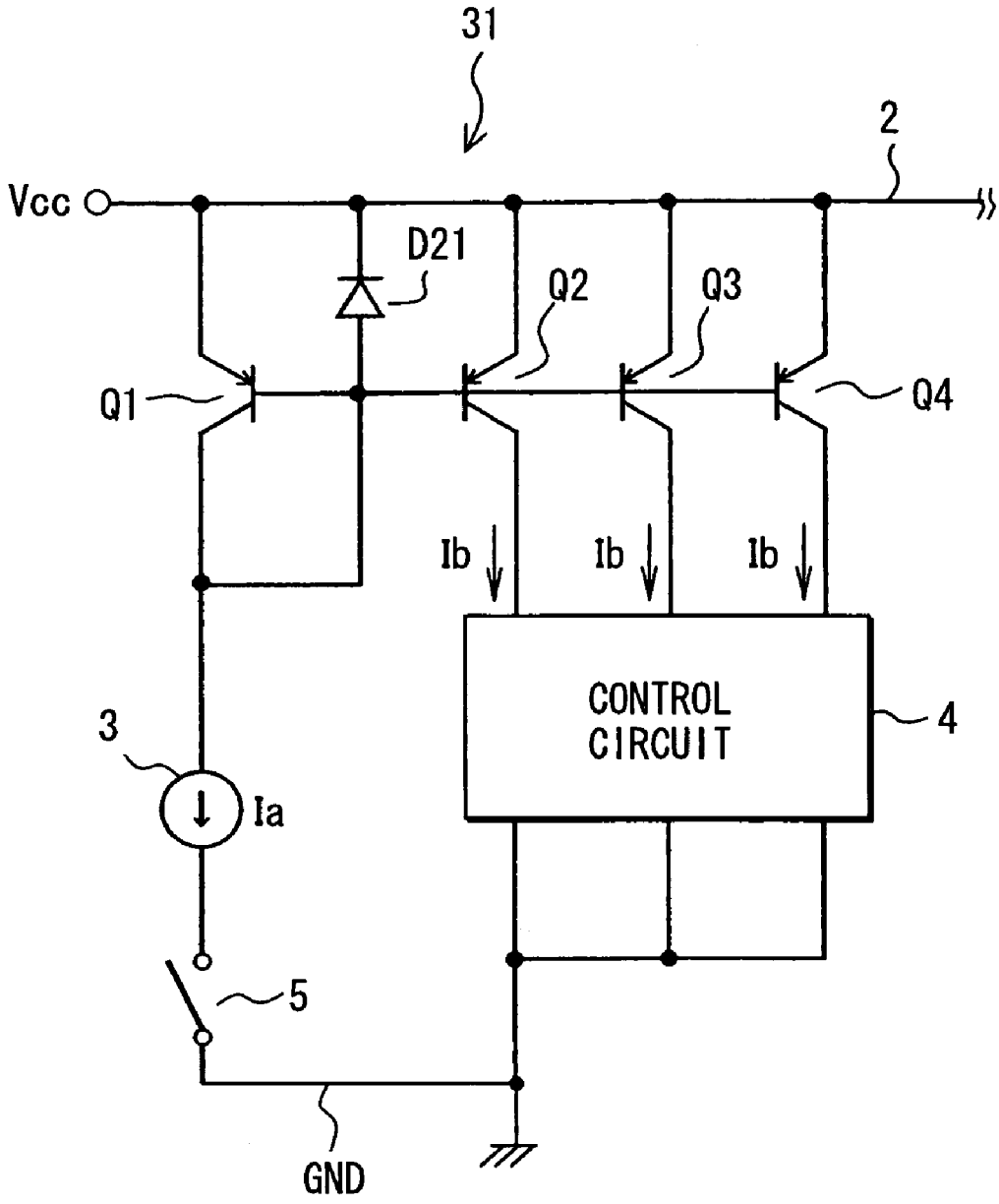
FIG. 5 is a schematic of a current mirror circuit according to a third embodiment of the present invention.

Referring to FIG. 5, a current mirror circuit 31 includes the transistors Q1-Q4 having bases coupled together and emitters connected to the power supply line 2. The current mirror circuit 31 further includes a Schottky barrier diode D21 having a cathode connected to the power supply line 2 and an anode connected to the bases of the transistors Q1-Q4. Thus, when the base-emitter junction of the transistors Q1-Q4 is forward biased, the Schottky barrier diode D21 is reverse biased.

As can be seen by comparing FIG. 5 with FIG. 1, a difference between the current mirror circuits 11, 31 is in that the current mirror circuit 31 includes the Schottky barrier diode D21 instead of the zener diode D1. Compared to other types of diodes, the Schottky barrier diode D21 produces has a large reverse current. Therefore, the Schottky barrier diode D21 has the resistance to clamp the base potential of the transistors Q1-Q4. Thus, the current mirror circuit 31 operates in the same manner as the current mirror circuit 11.

Fourth Embodiment

Figure 6:
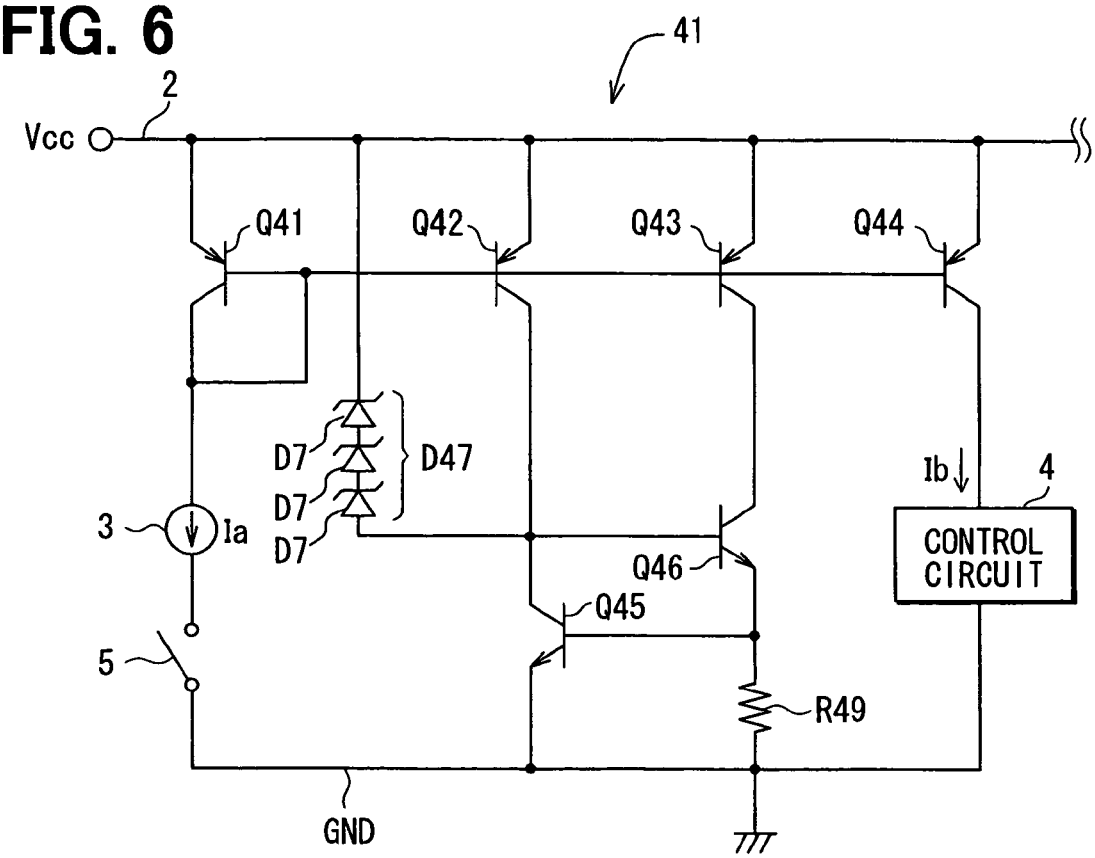
FIG. 6 is a schematic of a constant current circuit according to a fourth embodiment of the present invention.

Referring to FIG. 6, a constant current circuit 41 includes PNP transistors Q41-Q44, NPN transistors Q45, Q46, a zener diode member D47, a resistor R49, the constant current source 3, the control circuit 4, and the switch 5.

As shown in FIG. 6, the transistors Q41-Q44 have bases coupled together and emitters coupled together and connected to the power supply line 2. Thus, the transistors Q41-Q44 construct a current mirror circuit. Therefore, when the transistor Q41 is turned on, the transistors Q42-Q44 are turned on.

The base and collector of the transistor Q41 are coupled together. The constant current source 3 and the switch 5 are connected in series between the collector of the transistor Q41 and the ground line GND. When the switch 5 is closed, the power supply voltage Vcc is applied and the transistor Q41 is turned on.

Collectors of the transistor Q42, Q45 are coupled together. Collectors of the transistors Q43, Q46 are coupled together. The base of the transistor Q46 is coupled to the collector of the transistor Q45. The base of the transistor Q45 is coupled to an emitter of the transistor Q46. An emitter of the transistor Q45 is connected to the ground line GND. The emitter of the transistor Q46 is connected to the ground line GND through the resistor R49.

In the constant current circuit 41, although the base current of the transistor Q45 may increase with an increase in the power supply voltage Vcc due to early effect, the transistor Q46 cancels the early effect.

The transistor Q44 has a collector connected to the control circuit 4. When the transistor Q41 is turned on, the transistor Q44 is turned on and supplies the collector current Ib to the control circuit 4.

Figure 14:
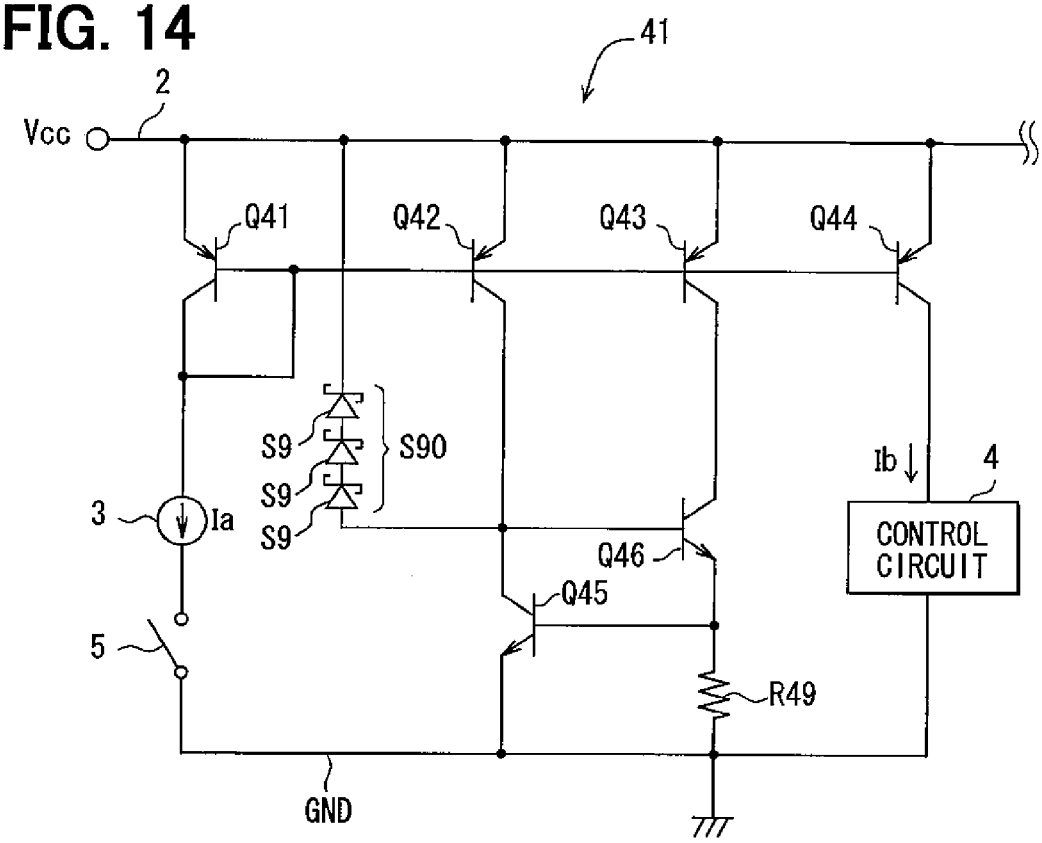
FIG. 14 is a schematic of a constant current circuit according to another modification of the current mirror circuit of FIG. 6.

The zener diode member D47 includes at least one zener diode D7. In this embodiment, as shown in FIG. 6, the zener diode member D47 includes three zener diodes D7 connected in series. The zener diode member D47 is connected in parallel with the transistor Q42. Specifically, the zener diode member D47 has a cathode connected to the power supply line 2 (i.e., emitter of the transistor Q42) and an anode connected to the base of the transistor Q46 (i.e., the collector of the transistor Q42). As shown in FIG. 14, the zener diode member D47 can be replaced with a Schottky diode member S90 having multiple Schottky diodes S9 connected in series.

Figure 7A:
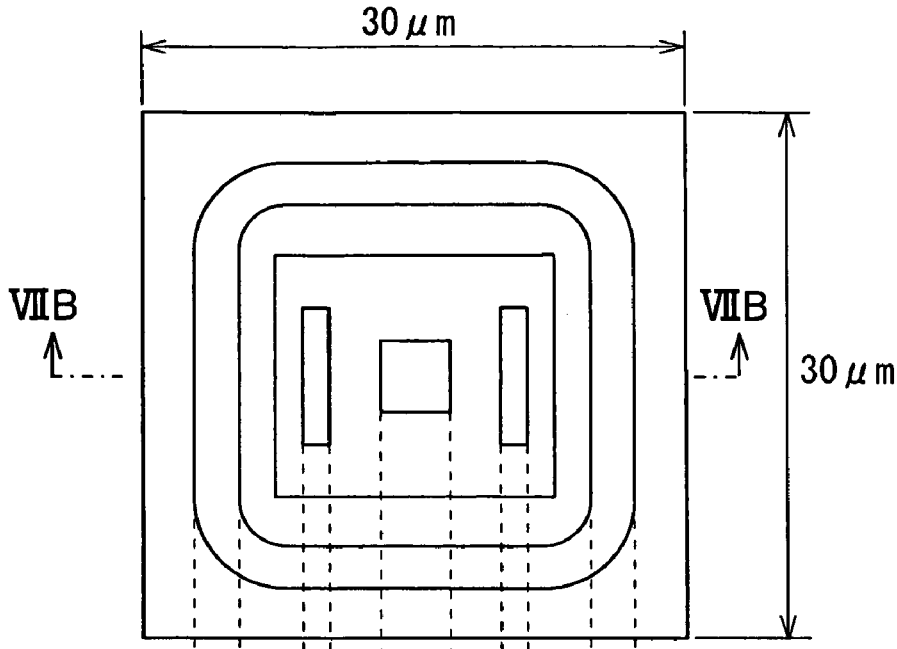
FIG. 7A is a top view of a zener diode used in the constant current circuit of FIG. 6.
Figure 7B:
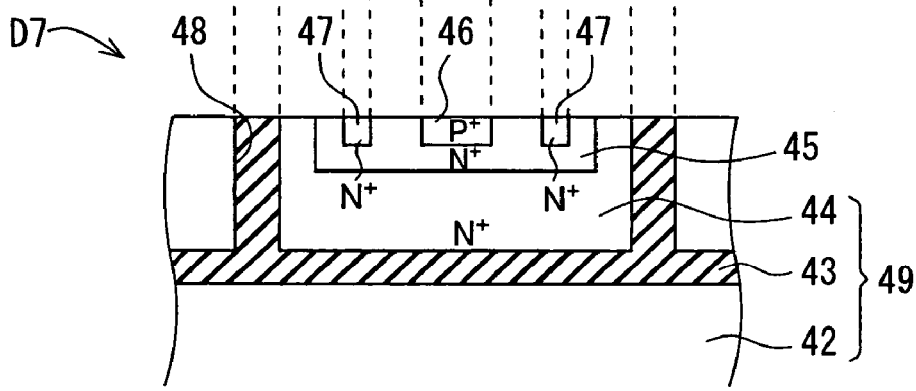
FIG. 7B is a cross sectional view of the zener diode taken along line VIIB-VIIB in FIG. 7A.

As shown in FIGS. 7A and 7B, the zener diode D7 is fabricated on a SOI substrate 49. The SOI substrate 49 includes an N-type silicon substrate 42, a silicon dioxide layer 43 on the silicon substrate 42, and an N+ silicon layer 44 on the silicon dioxide layer 43. The silicon dioxide layer 43 provides electrical isolation.

The N+ silicon layer 44 includes an N+ diffusion layer 45 with the impurity concentration greater than that of the N+ silicon layer 44.

A P+ diffusion layer 46 is fabricated in the center of the surface of the N+ diffusion layer 45. The P+ diffusion layer 46 acts as the anode of the zener diode D7. A pair of N+ diffusion layers 47 is fabricated in the surface of the N+ diffusion layer 45 to face each other across the P+ diffusion layer 46. The N+ diffusion layers 47 may be provided as a single piece to surround the P+ diffusion layer 46. The N+ diffusion layers 47 have the impurity concentration greater than that of the N+ diffusion layer 45. The N+ diffusion layers 45, 47 act as the cathode of the zener diode D7.

A trench 48 filled with the silicon dioxide layer 43 electrically isolates adjacent zener diodes D7. The zener diode D7 has the layout area of about 30 μm×30 μm.

The diffusion layers 45-47 of the zener diode D7 has the impurity concentration such that the zener diode D7 produces the reverse current when the zener diode D7 is reverse biased at a voltage lower than a reverse breakdown voltage (i.e., zener voltage) of the zener diode D7. In such an approach, the reverse current flows through the zener diode D7 and a voltage drop appears across the zener diode D7. In short, the zener diode D7 acts as the resistor. The voltage drop can be increased by using multiple zener diodes D7 connected in series.

For example, the zener diode D7 has the breakdown voltage of about 5 V, the zener diode D7 acts as the resistor of 500 kΩ. Whereas the resistor of 500 kΩ has the layout area of 70 μm×70 μm, the zener diode D7 has the layout area of 30 μm×30 μm, as shown in FIG. 7A. Therefore, the constant current circuit 41 can be reduced in size.

The N+ diffusion layer 45 has the impurity concentration of equal to or more than $1.0\times10^{20}$ $cm^{-3}$. For example, the N+ diffusion layer 45 has the impurity concentration of $1.0\times10^{20}$ $cm^{-3}$. The P+ diffusion layer 46 has the impurity concentration of equal to or more than $2.0\times10^{17}$ $cm^{3}$. The N+ diffusion layers 47 have the impurity concentration of between $1.0\times10^{18}$ $cm^{-3}$ and $1.0\times10^{21}$ $cm^{-3}$. For example, the N+ diffusion layers 47 have the impurity concentration of $2.0\times10^{20}$ $cm^{-3}$. The reverse current of the zener diode D7 increases with an increase in the impurity concentration of the P+ diffusion layer 46.

Figure 8:
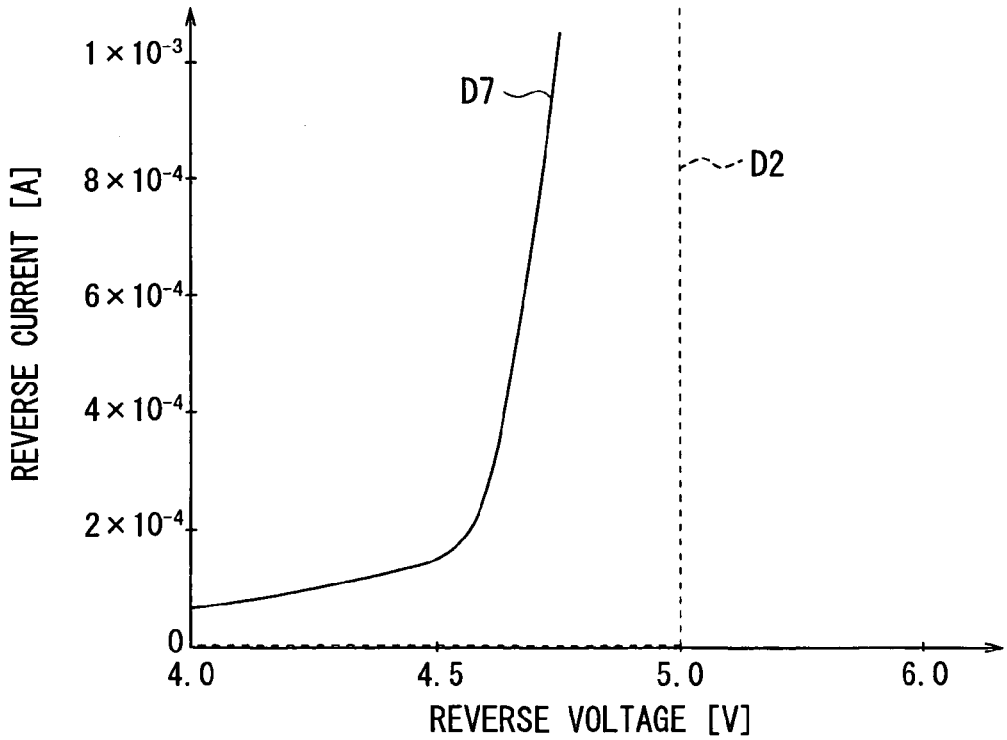
FIG. 8 is a graph showing volt-ampere characteristics of the conventional zener diode and the zener diode used in the constant current circuit of FIG. 6.

FIG. 8 shows volt-ampere characteristics of the zener diode D7 and the standard zener diode D2.

As shown in FIG. 8, the reverse current flows through the zener diode D7 when the zener diode D7 is reverse biased at the voltage lower than the breakdown voltage of the zener diode D7. The reverse current of the zener diode D7 increases with an increase in the reverse bias voltage applied to the zener diode D7. Thus, the zener diode D7 act as the resistor.

The constant current circuit 41 operates as follows:

When the switch 5 is opened, no current flows through the transistor Q41. Therefore, the constant current circuit 41 is in OFF condition.

When the switch 5 is closed, the power supply voltage Vcc is applied and the forward bias voltage VF appears between the base and emitter of the transistors Q41-Q44. Then, the reserve current flows through the zener diode member D47 and reaches the base of the transistor Q46. Thus, the current flows between the base and emitter of the transistor Q46 so that a voltage appears across the resistor R49. The voltage across the resistor R49 is applied to the base of the transistor Q45 so that the current flows between the base and emitter of the transistor Q45. Thus, the transistors Q45, Q46 are turned on.

When the transistors Q45, Q46 are turned on, the transistors Q42-Q44 are turned on. Thus, the collector current 1*b* of the transistor Q44 is supplied to the control circuit 4.

As described above, the constant current circuit 41 includes the zener diode member D47 having at least one zener diode D7. The diffusion layers 45-47 of the zener diode D7 has the impurity concentration such that the reverse current flows through the zener diode D7 when the zener diode D7 is reverse biased at the voltage lower than the breakdown voltage. Thus, the zener diode member D47 provides the reverse current to the base of the transistor Q46 when the zener diode member D47 is reverse biased at the forward bias voltage VF. Then, the transistor Q46 is turned on and the transistor Q44 is turned on. Thus, the collector current Ib is supplied to the control circuit 4.

The zener diode member D47 produces the reverse current and the voltage drop appears across the zener diode member D47. Therefore, the zener diode member D47 acts as the resistor. Since the zener diode member D47 is used instead of the resistor, the constant current circuit 41 can be reduced in size. Accordingly, the IC having the constant current circuit 41 can be reduced in size.

Fifth Embodiment

Figure 9:
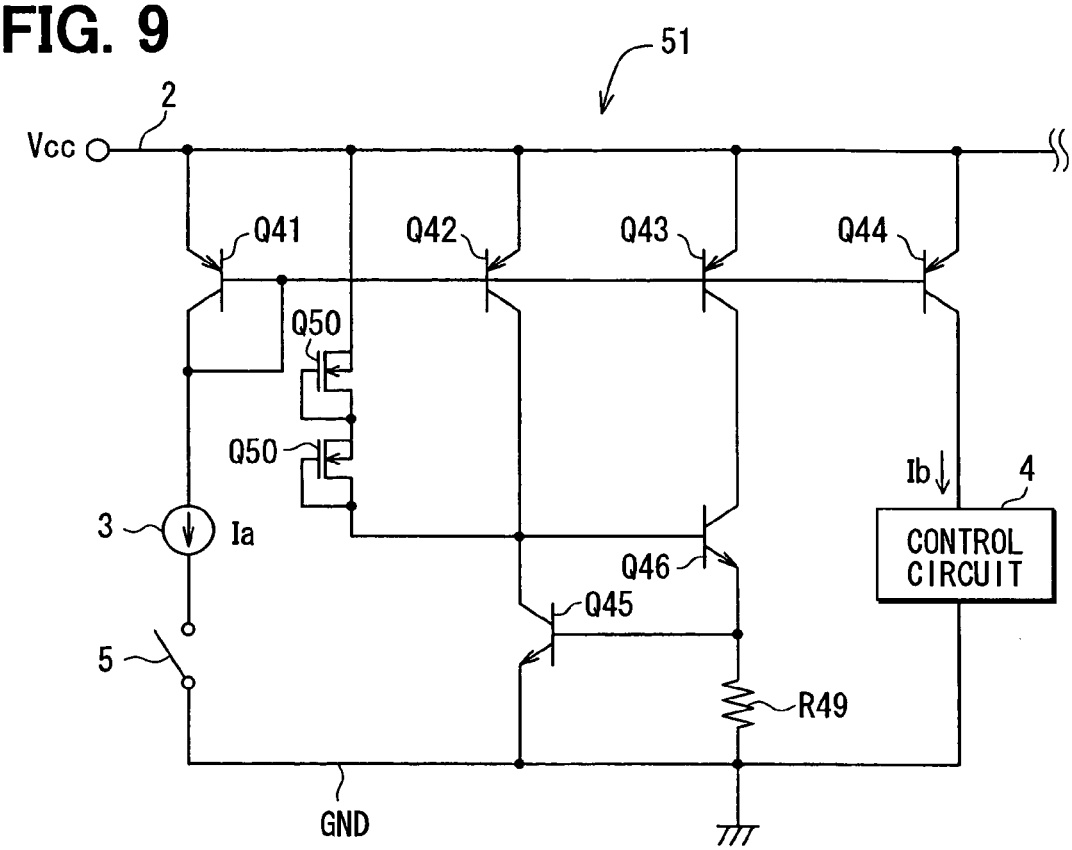
FIG. 9 is a schematic of a constant current circuit according to a fifth embodiment of the present invention.

Referring to FIG. 9, a constant current circuit 51 includes a FET Q50 instead of the zener diode member D47. A gate and source of the FET Q50 are coupled together. The FET Q50 has an on-resistance and provides the reverse current to the base of the transistor Q46 based on the on-resistance. Thus, as with the zener diode member D47, the FET Q50 acts as the resistor. The amount of the reverse current depends on the gate length and width of the FET Q50. In other words, the on-resistance can be adjusted by adjusting the gate length and width. For example, when the FET Q50 has the gate length of 1.6 μm and the gate width of 4 μm, the FET Q50 acts as the resistor of 10 kΩ. Since the FET Q50 is used instead of the resistor, the constant current circuit 51 can be reduced in size. Accordingly, the IC having the constant current circuit 51 can be reduced in size.

(Modifications)

Figure 10:
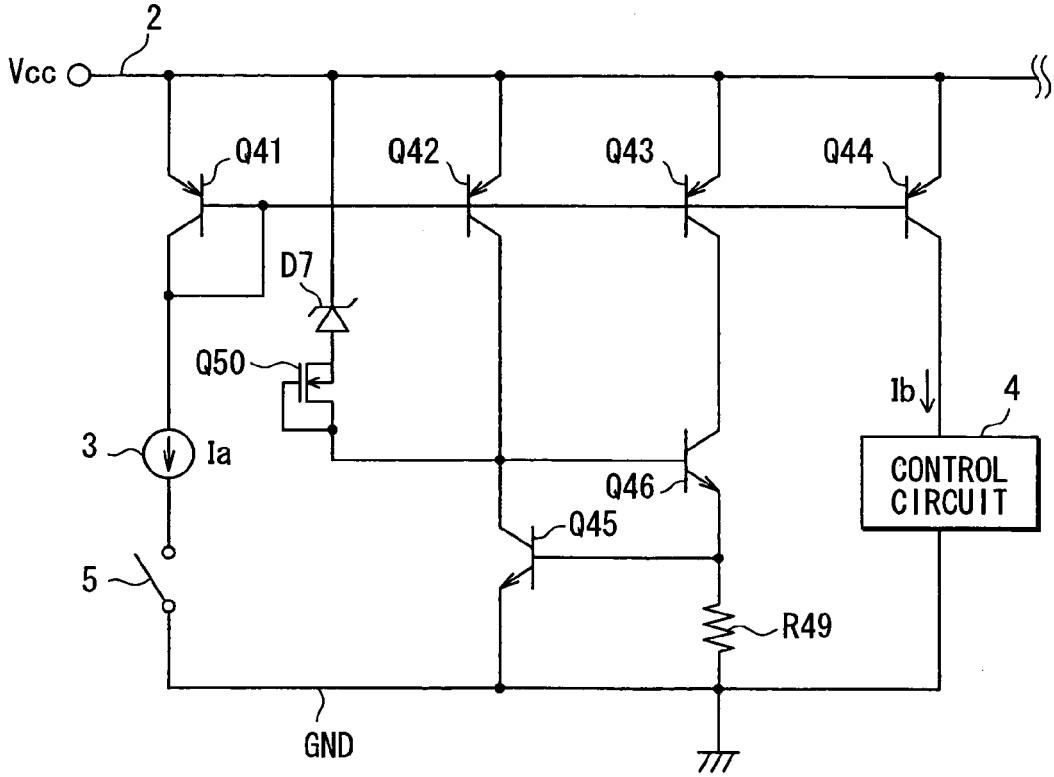
FIG. 10 is a schematic of a constant current circuit according to a modification of the constant current circuit of FIG. 6.
Figure 11:
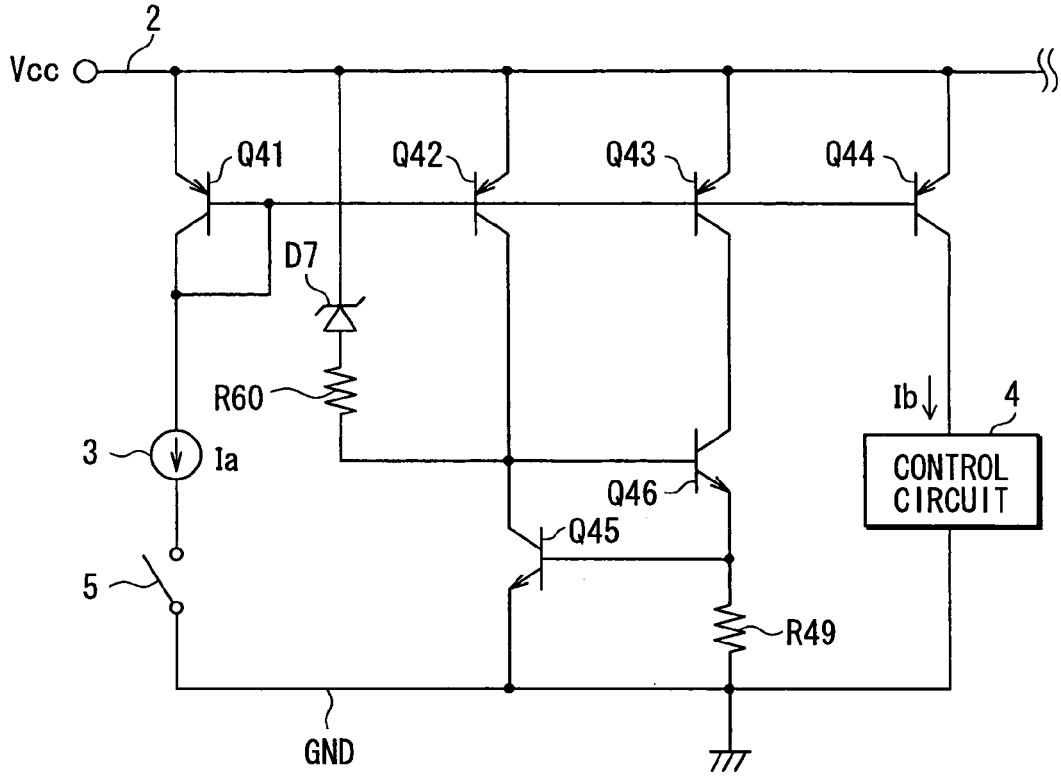
FIG. 11 is a schematic of a constant current circuit according to another modification of the constant current circuit of FIG. 6.
Figure 12:
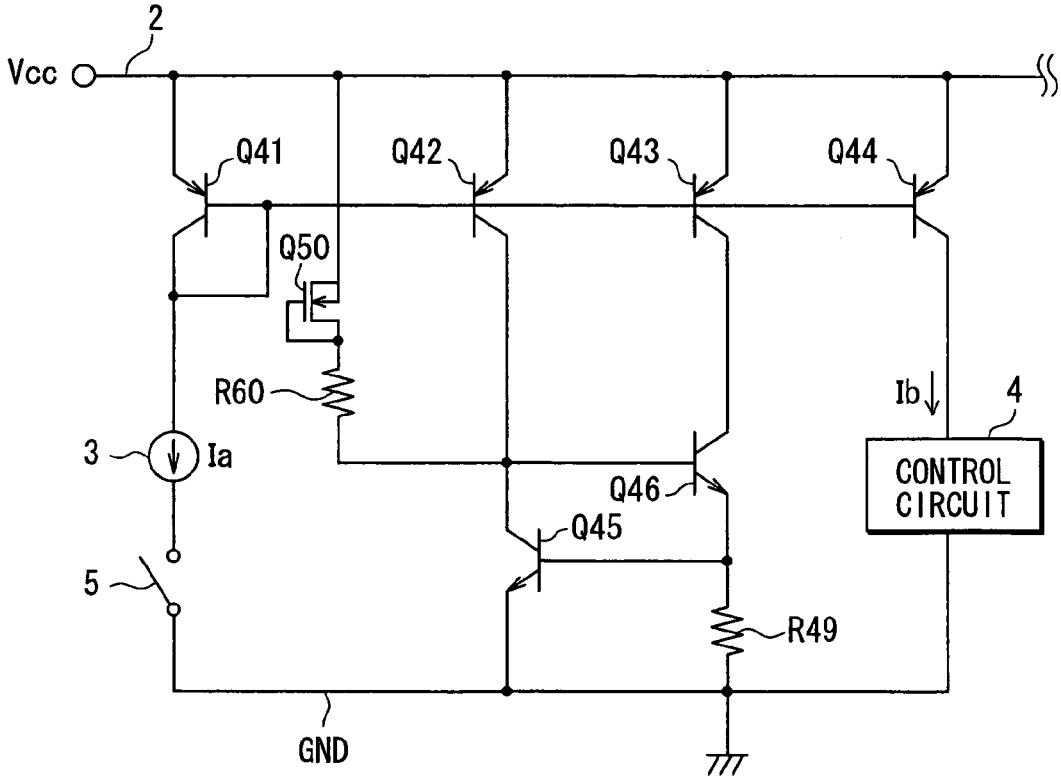
FIG. 12 is a schematic of a constant current circuit according to another modification of the constant current circuit of FIG. 6.
Figure 13:
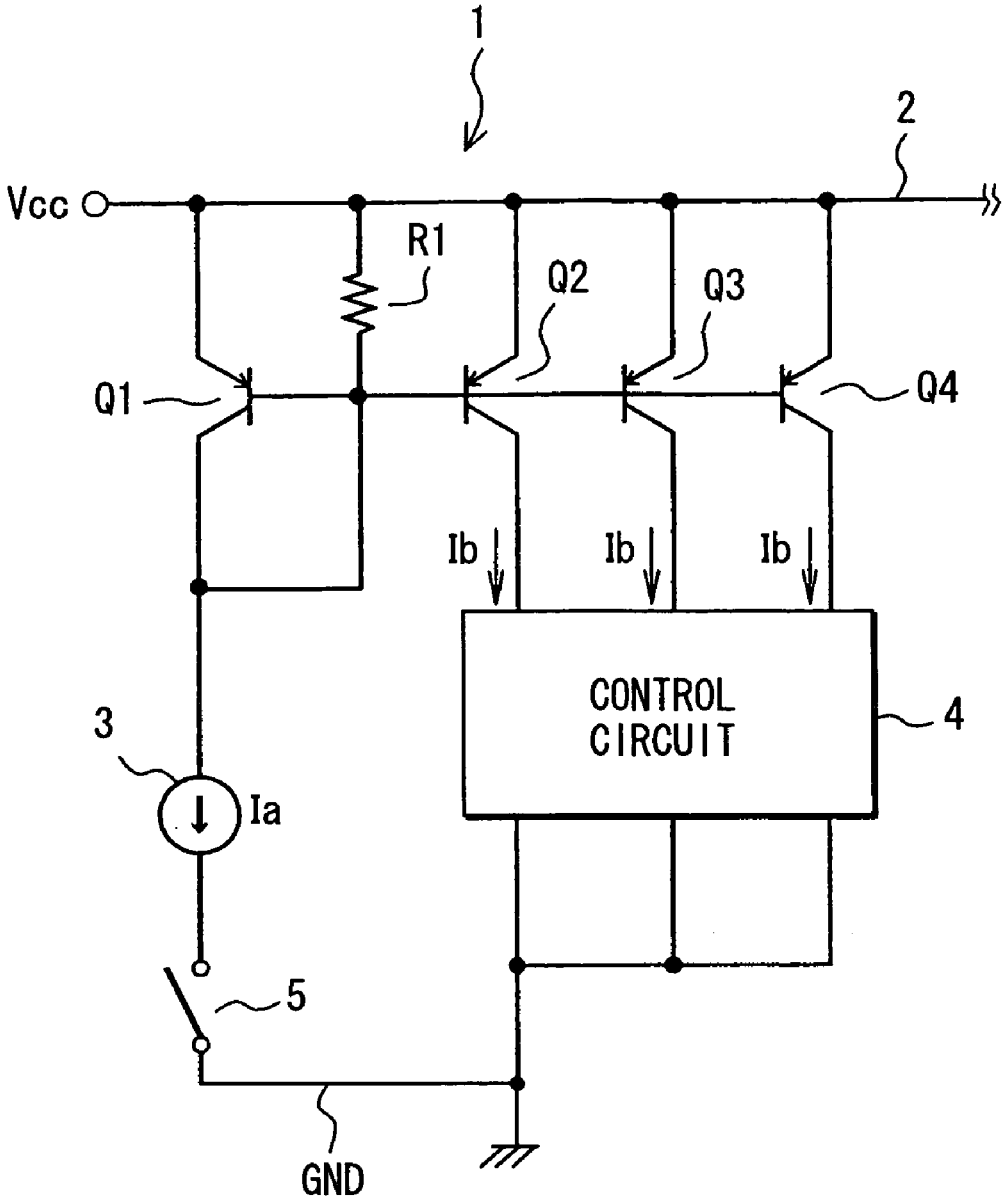
FIG. 13 PRIOR ART
FIG. 13 is a schematic of a conventional current mirror circuit.
Figure 15:
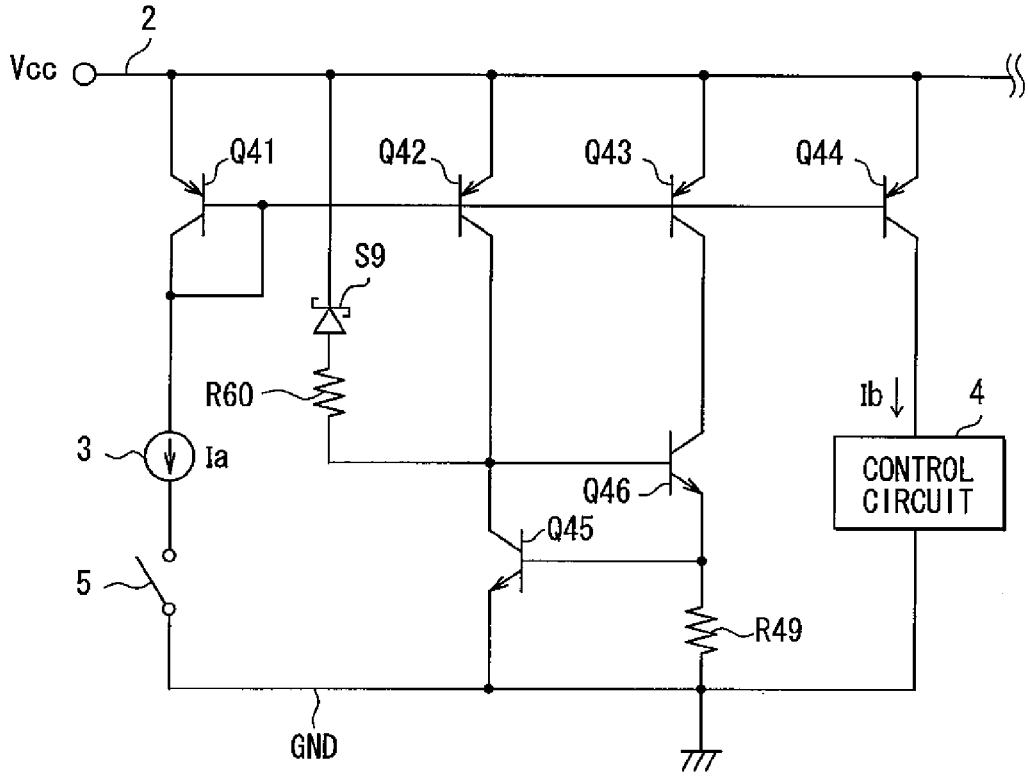
FIG. 15 is a schematic of a constant current circuit according to another modification of the current mirror circuit of FIG. 6.

The embodiments described above may be modified in various ways. For example, as shown in FIG. 10, the FET Q50 and the zener diode D7 connected in series with the FET Q50 may be used instead of the zener diode member D47. As shown in FIG. 11, the zener diode D7 and a resistor R60 connected in series with the zener diode D7 may be used instead of the zener diode member D47. As shown in FIG. 12, the FET Q50 and the resistor R60 connected in series with the FET Q50 may be used instead of the zener diode member D47. As shown in FIG. 15, a series circuit of the Schottky diode S9 and the resistor R60 may be used instead of the zener diode member D47.

The Schottky barrier diode may be used instead of the zener diodes D1, D7. FETs may be used instead of the transistors Q41-Q46. The emitters of the transistors Q1-Q4, Q41-Q44 may be connected to the power supply line 2 through a resistor. Likewise, the sources of the FETs Q11-Q14 may be connected to the power supply line 2 through the resistor.

The zener diodes D1, D7 may have a p-n junction isolation structure, a local oxidation of silicon (LOCOS) structure, or a shallow trench isolation (STI) structure.

The impurity concentration of the diffusion layers 15-17, 45-47 of the zener diodes D1, D7 can be adjusted according to, for example, required accuracy of the mirror gain, the amount of the current flowing through the current mirror circuit, and the amount of noise applied to the current mirror circuit.

Such changes and modifications are to be understood as being within the scope of the present invention as defined by the appended claims.

What is claimed is:

1. A current mirror circuit comprising:

a plurality of bipolar transistors having bases coupled together and emitters connected to a voltage line; and a zener diode having an anode connected to the bases and a cathode connected to the voltage line, wherein the zener diode has a breakdown voltage higher than a base-emitter forward voltage of each of the transistors, the zener diode includes a first conductive diffusion layer having a first impurity concentration and a second conductive diffusion layer having a second impurity concentration greater than the first impurity concentration, and the first impurity concentration is equal to or more than $1.0\times10^{20}cm^{-3}$.

2. A constant current circuit for outputting a constant current, the constant current circuit comprising:

a current mirror circuit that includes a first transistor acting as an input transistor and second to fourth transistors acting as output transistors, the first to fourth transistors having bases coupled together and emitters connected to a voltage line;

a fifth transistor having a collector connected to a collector of the second transistor;

a sixth transistor having a collector connected to a collector of the third transistor, a base connected to the collector of the fifth transistor, and an emitter connected to a base of the fifth transistor; and a Schottky diode connected between the base of the sixth transistor and the voltage line, wherein the Schottky diode has a breakdown voltage and provides a reverse current to the base of the sixth transistor at a reverse bias voltage lower than the breakdown voltage, and the constant current is a collector current of the fourth transistor.

3. The constant current circuit according to claim 2, wherein the Schottky diode is one of a plurality of Schottky diodes connected in series.

4. The constant current circuit according to claim 2, further comprising a resistor connected in series with the Schottky diode.

5. A constant current circuit for outputting a constant current, the constant current circuit comprising:

a current mirror circuit that includes a first transistor acting as an input transistor and second to fourth transistors acting as output transistors, the first to fourth transistors having bases coupled together and emitters connected to a voltage line;

a fifth transistor having a collector connected to a collector of the second transistor;

a sixth transistor having a collector connected to a collector of the third transistor, a base connected to the collector of the fifth transistor, and an emitter connected to a base of the fifth transistor; and a zener diode connected between the base of the sixth transistor and the voltage line, wherein the zener diode has a breakdown voltage and provides a reverse current to the base of the sixth transistor at a reverse bias voltage lower than the breakdown voltage, and the constant current is a collector current of the fourth transistor.

6. The constant current circuit according to claim 5, wherein the zener diode is one of a plurality of zener diodes connected in series.

7. The constant current circuit according to claim 5, further comprising at least one of a field-effect transistor, a Schottky diode, and a resistor connected in series with the zener diode.

8. A constant current circuit for outputting a constant current, the constant current circuit comprising:

a current mirror circuit that includes a first transistor acting as an input transistor and second to fourth transistors acting as output transistors, the first to fourth transistors having bases coupled together and emitters connected to a voltage line;

a fifth transistor having a collector connected to a collector of the second transistor;

a sixth transistor having a collector connected to a collector of the third transistor, a base connected to the collector of the fifth transistor, and an emitter connected to a base of the fifth transistor; and a field-effect transistor connected between the base of the sixth transistor and the voltage line and having a gate and a drain coupled to the gate, wherein the field-effect transistor has an on-resistance and provides a reverse current to the base of the sixth transistor based on the on-resistance, and the constant current is a collector current of the fourth transistor.

9. The constant current circuit according to claim 8, wherein the field-effect transistor is one of a plurality of field-effect transistors connected in series.

10. The constant current circuit according to claim 8, further comprising at least one of a Schottky diode and a resistor connected in series with the field-effect transistor.

* * * * *